US011251558B1

(12) United States Patent
Lee

(10) Patent No.: US 11,251,558 B1
(45) Date of Patent: Feb. 15, 2022

(54) ELECTRICAL CONNECTER CAPABLE OF IMPROVING HIGH FREQUENCY CHARACTERISTICS

(71) Applicant: ACES ELECTRONICS CO., LTD., Taoyuan (TW)

(72) Inventor: I-Hung Lee, Taoyuan (TW)

(73) Assignee: ACES ELECTRONICS CO., LTD., Taoyuan (TW)

( * ) Notice: Subject to any disclaimer, the term of this patent is extended or adjusted under 35 U.S.C. 154(b) by 0 days.

(21) Appl. No.: 17/127,378

(22) Filed: Dec. 18, 2020

(51) Int. Cl.

| | |
|---|---|
| ***H01R 13/24*** | (2006.01) |
| ***H01R 12/70*** | (2011.01) |
| ***H01R 13/627*** | (2006.01) |
| ***H01R 13/6599*** | (2011.01) |

(52) U.S. Cl.
CPC ..... *H01R 13/2471* (2013.01); *H01R 12/7064* (2013.01); *H01R 13/6277* (2013.01); *H01R 13/6599* (2013.01)

(58) Field of Classification Search
CPC ..... H01R 13/2471; H01R 13/6277; H01R 13/03; H01R 13/035; H01R 12/7064; H01R 24/40
See application file for complete search history.

(56) References Cited

U.S. PATENT DOCUMENTS

| | | | | |
|---|---|---|---|---|
| 8,491,313 | B2 * | 7/2013 | McNamara | H01R 13/6461 439/59 |
| 9,166,317 | B2 * | 10/2015 | Briant | H01R 12/737 |
| 9,935,385 | B2 * | 4/2018 | Phillips | H01R 13/26 |

* cited by examiner

*Primary Examiner* — Briggitte R. Hammond
(74) *Attorney, Agent, or Firm* — Muncy, Geissler, Olds & Lowe, P.C.

(57) ABSTRACT

An electrical connector includes an electrically conductive plastic member having positioning grooves and connecting blocks arranged continuously, a side plate on one side of each positioning groove, a concave wall on an opposite side of each positioning groove and each of two opposite sides of each connecting block and butting bumps protruded from the side plates and the concave walls, and a terminal block provided with conductive terminals and having buckle blocks bent downward from one side thereof and used to be buckled to respective positioning grooves, abutment blocks formed on the buckle blocks for abutting against respective concave wall and proximity grooves provided between the adjacent said buckle blocks or the abutment blocks for respective butting bumps to extend and abut.

6 Claims, 4 Drawing Sheets

ELECTRICAL CONNECTER CAPABLE OF IMPROVING HIGH FREQUENCY CHARACTERISTICS

BACKGROUND OF THE INVENTION

1. Field of the Invention

The present invention relates to electrical connector technology, and more particularly to an electrical connector capable of improving high frequency characteristics, which has an electrically conductive plastic member provided between two terminal blocks to form a strong structure that has both flexibility and ductility when the preset board is inserted, and at the same time, the structure can improve the crosstalk and short circuit problems between conductive terminals, and the data performance during high-speed signal transmission is more ideal.

2. Description of the Related Art

Nowadays, the electronics industry is rapidly growing and maturing. Many electronic products with different 3C functions have been developed and manufactured according to different needs, especially the overlap speed of computers, laptops, tablets and smart phones is beyond imagination. The direction of the update is nothing more than processor computing speed, network transmission speed and lighter, thinner, shorter, and smaller size. In addition to the smaller size of electronic products, different interface connectors are required to expand more functions.

The miniaturization of electronic products is largely due to the evolution of the wafer process. When the line width of the chip reaches 28 nm, 14 nm, 10 nm and the latest 7 nm, the circuit board and the corresponding connector are also miniaturized. When the connector size is reduced, the distance between the terminals of the terminal set is too close, and the problem of electromagnetic waves and crosstalk interference is also generated when high-frequency signals are transmitted. The crosstalk interference problem has an absolute impact on the transmission signal speed. The high-frequency connector includes an insulating body, differential signal terminal pairs installed in the insulating body, a ground terminal arranged between two adjacent differential signal terminal pairs, and a ground plate that connects these ground terminals in series. However, the structure of the grounding plate is complicated and the assembly steps in series with the grounding terminal are too many, which affects the assembly man-hours. After assembly, the ground plate and the differential signal terminal pairs are prone to short circuits due to close distance, tin wire generation, or assembly errors. Moreover, the high-frequency connector tends to excessively stretch the terminal blocks on both sides outwards when the board is plugged in, and it will form a situation where the conductive terminals provided on the terminal blocks and the metal contacts of the inserted board are in poor contact over time. Therefore, the overall structure and grounding structure strength is not good, and crosstalk and short circuit problems are generated between the conductive terminals. This structural design is difficult to support high-speed signal data transmission, and needs to be improved by those engaged in this industry.

SUMMARY OF THE INVENTION

The present invention has been accomplished under the circumstances in view. It is therefore the main object of the present invention to provide an electrical connector capable of improving high frequency characteristics, which comprises an electrically conductive plastic member and at least one terminal block. The electrically conductive plastic member comprises a plurality of positioning grooves and a plurality of connecting blocks with a hollow rectangular appearance arranged continuously, a side plate on one side of each positioning groove, a concave wall on an opposite side of each positioning groove and each of two opposite sides of each connecting block, and a butting bump protruded from at least one side of each of the side plates and the concave walls. The at least one terminal block is assembled in an accommodation space of a preset insulating housing, and is provided with a plurality of conductive terminals composed of a plurality of signal terminals and a plurality of ground terminals. The terminal block comprises a plurality of buckle blocks bent downward from one side thereof and used to be buckled to respective positioning grooves of the electrically conductive plastic member, an abutment block formed on at least one side of each buckle block for abutting against one respective concave wall of the electrically conductive plastic member, and a proximity groove provided between the adjacent buckle blocks or abutment blocks for one respective butting bump of the electrically conductive plastic member to extend and abut. The electrically conductive plastic member is provided between the two terminal blocks to form a strong structure, and it has both flexibility and ductility when the preset board is inserted. At the same time, it can improve the crosstalk and short circuit problems between the conductive terminals, and the data performance during high-speed signal transmission is more ideal.

Preferably, each buckle block has an inner side thereof recessed with a slot for the snap-fit of one respective side plate.

Preferably, each buckle block has an arc angle formed on each of two opposite lateral sides of an outer wall thereof, and each positioning groove for one respective buckle block to be buckled is provided with two arc-shaped walls corresponding to the arc angles of the respective buckle block.

Preferably, two terminal blocks are bilaterally assembled with the electrically conductive plastic member, so that a plug-in space is defined between the two terminal blocks for the insertion of a preset board.

Preferably, the proximity grooves of the at least one terminal block are provided corresponding to the ground terminals, and the buckle blocks and the abutment blocks are provided corresponding to the signal terminals.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
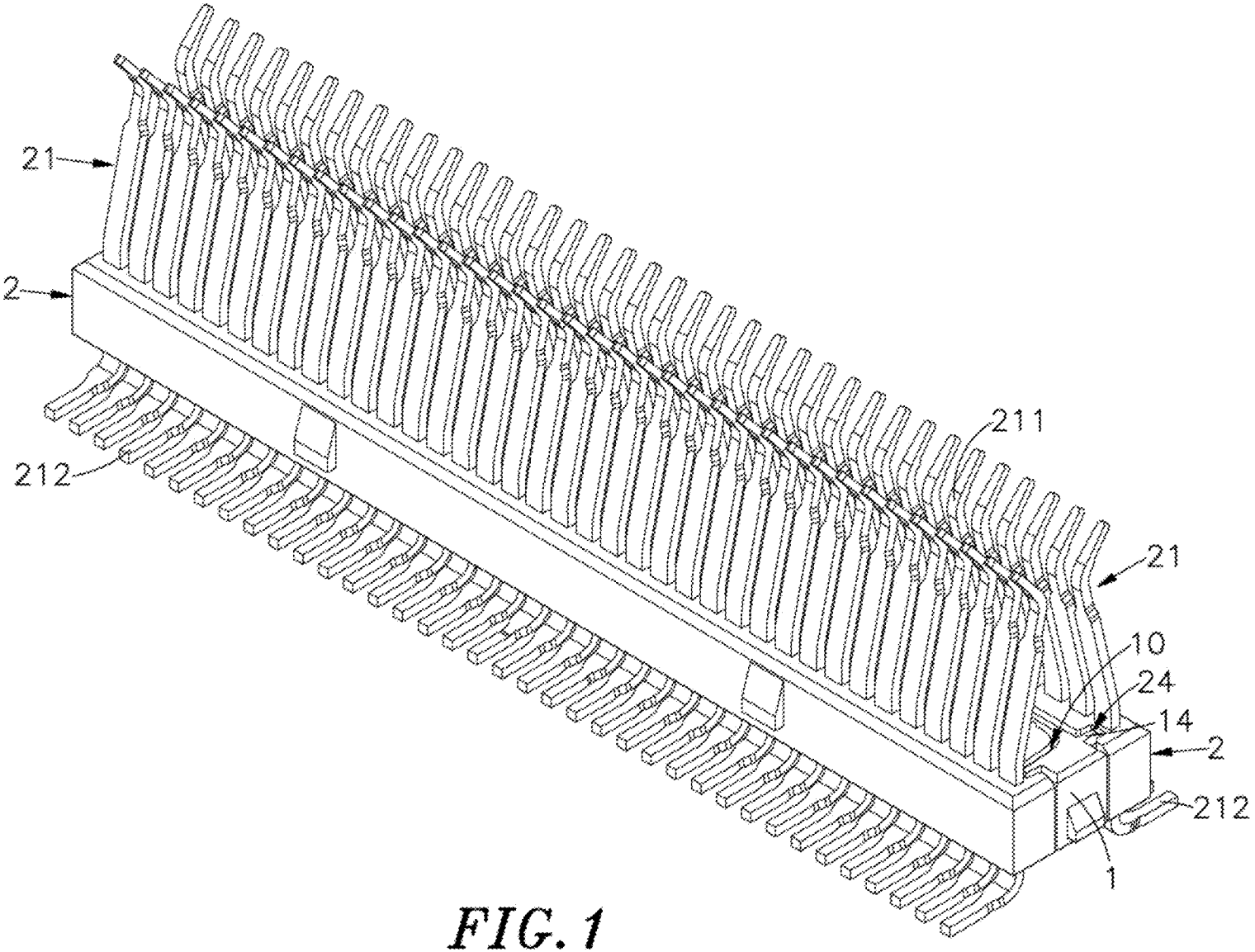
FIG. 1 is an oblique top elevational view of an electrical connector capable of improving high frequency characteristics in accordance with the present invention.
Figure 2:
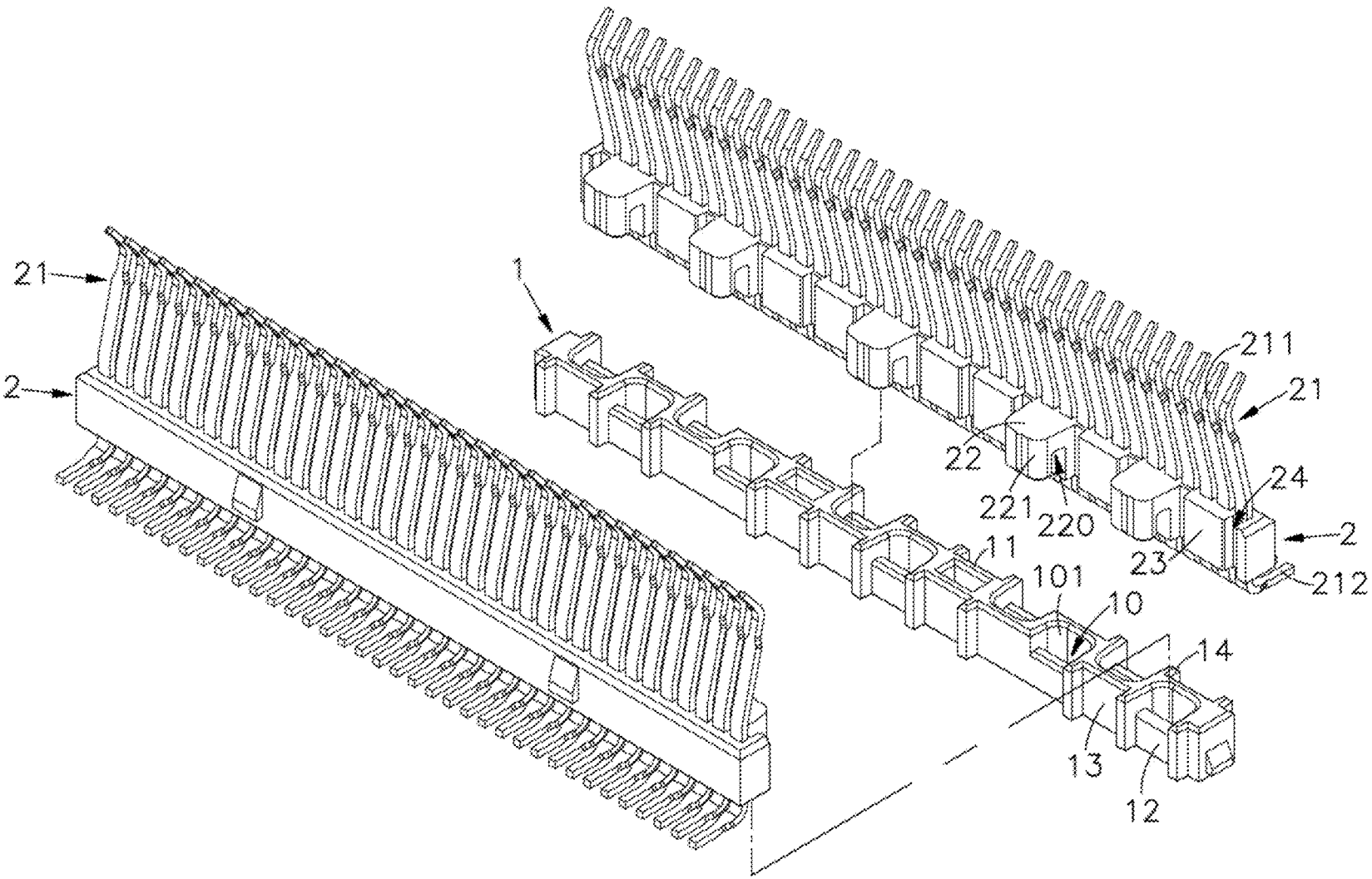
FIG. 2 is an exploded view of the electrical connector shown in FIG. 1.
Figure 3:
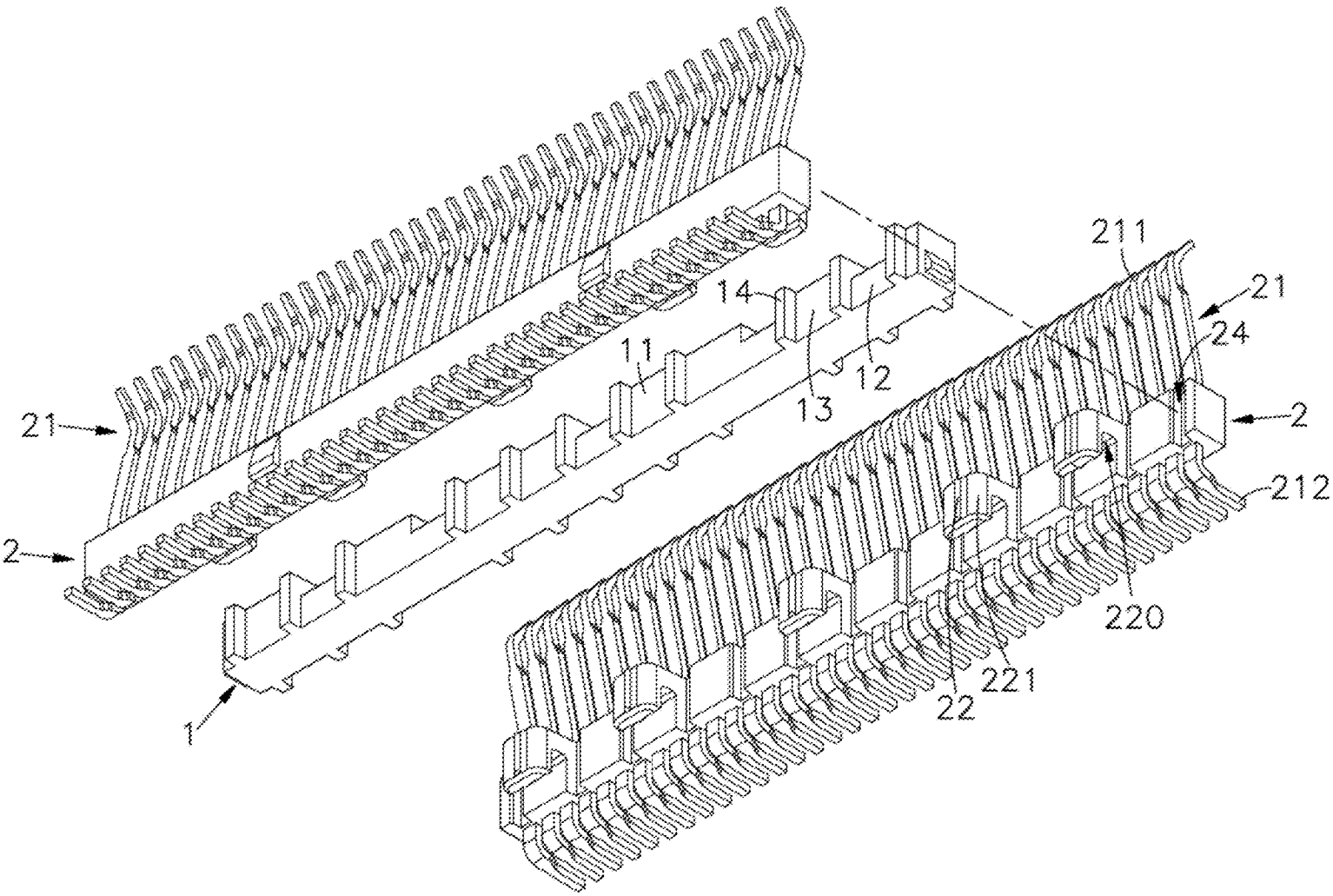
FIG. 3 corresponds to FIG. 2 when viewed from another angle.
Figure 4:
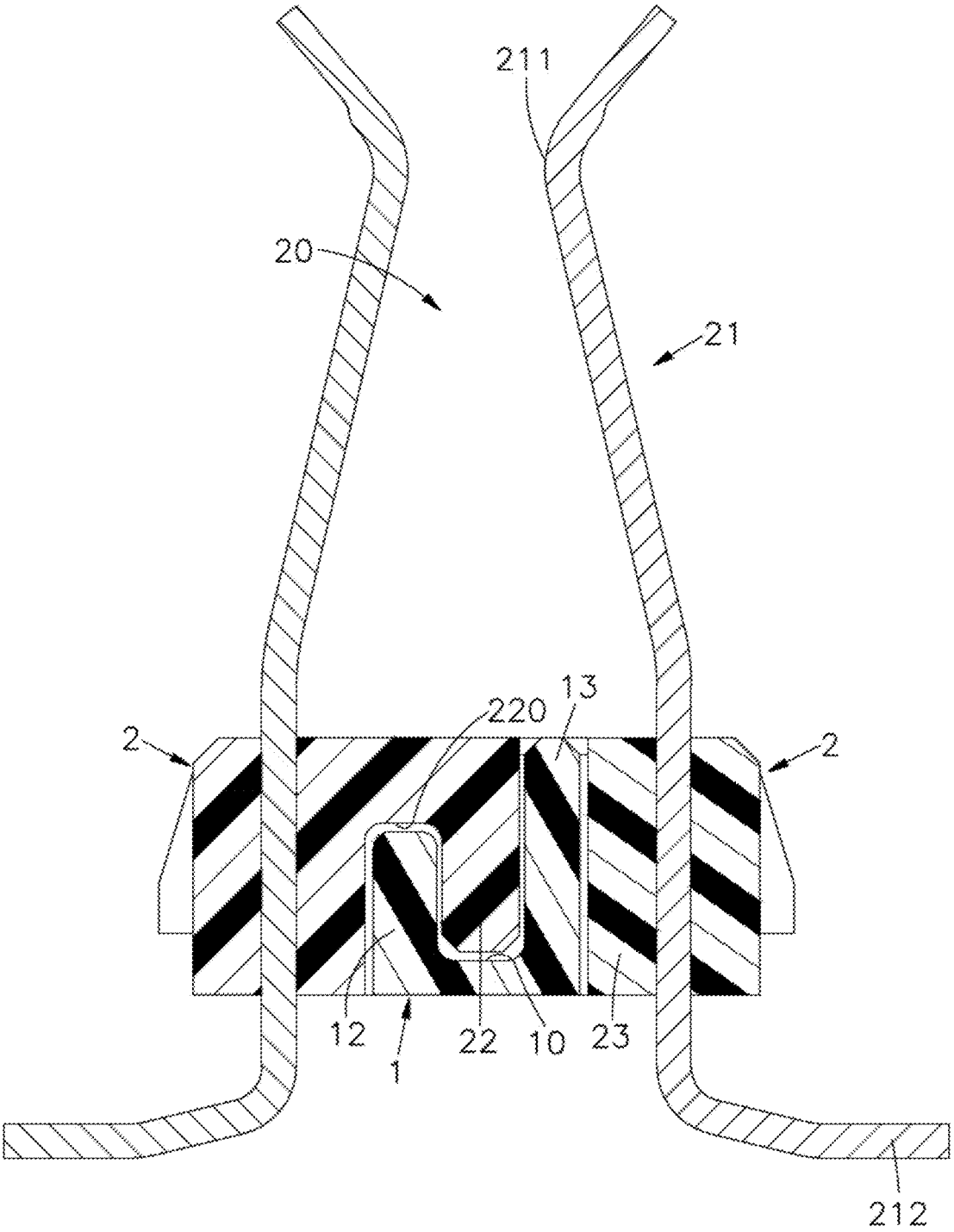
FIG. 4 is a sectional side view of the electrical connector in accordance with the present invention.

Referring to FIGS. 1-4, an oblique top elevational view of an electrical connector capable of improving high frequency characteristics in accordance with the present invention, an exploded view of the electrical connector, another exploded view of the electrical connector and a sectional side view of the electrical connector are shown. As illustrated, the electrical connector capable of improving high frequency characteristics comprises an electrically conductive plastic member 1 and at least one terminal block 2. The detailed structure and connection relationship of the aforementioned components are as follows:

The electrically conductive plastic member 1 comprises a plurality of positioning grooves 10 and a plurality of connecting blocks 11 with a hollow rectangular appearance arranged continuously, a side plate 12 on one side of each positioning groove 10, a concave wall 13 on the other side of each positioning groove 10 and each of two opposite sides of each connecting block 11, and a butting bump 14 protruded from at least one side of each of the side plates 12 and the concave walls 13.

The at least one terminal block 2 is assembled in an accommodation space (not shown in the drawings) of a preset insulating housing (not shown in the drawings). The terminal block 2 is provided with a plurality of conductive terminals 21 composed of a plurality of signal terminals and a plurality of ground terminals. The terminal block 2 comprises a plurality of buckle blocks 22 bent downward from one side thereof and used to be buckled to respective positioning grooves 10 of the electrically conductive plastic member 1, an abutment block 23 formed on at least one side of each buckle block 22 for abutting against one respective concave wall 13 of the electrically conductive plastic member 1, and a proximity groove 24 provided between the adjacent buckle blocks 22 or the abutment blocks 23 for one respective butting bump 14 of the electrically conductive plastic member 1 to extend and abut.

In a preferred embodiment, two terminal blocks 2 are respectively assembled to the two opposite sides of the electrically conductive plastic member 1, and a plug-in space 20 is defined between the two terminal blocks 2 for the insertion of a preset board (not shown in the drawings).

Each buckle block 22 has an inner side thereof recessed with a slot 220 for the snap-fit of one respective side plate 12, and an arc angle 221 formed on each of two opposite lateral sides of an outer wall thereof. Each positioning groove 10 for one respective buckle block 22 to be buckled is also correspondingly provided with two arc-shaped walls 101.

The conductive terminals 21 each have one end thereof bent outward to form a butting portion 211, and an opposite end thereof bent to form a bonding portion 212. The terminal block 2 and the conductive terminals 21 are combined using insert molding technology.

The proximity grooves 24 of the terminal block 2 are set corresponding to the ground terminals. The buckle blocks 22 and the abutment blocks 23 are set corresponding to the signal terminals.

When you want to assemble the electrical connector of the present invention, the terminal block 2 and the plural conductive terminals 21 have been pre-formed by the insert molding technology, so there is no need to assemble it. Then use electrically conductive plastic member 1 as a stationary member, first align the terminal block 2 with one side of electrically conductive plastic member 1, and buckle blocks 22 of the terminal block 2 are buckled into the respective positioning grooves 10 of the electrically conductive plastic member 1 from top to bottom. At the same time, the side plate 12 at one side of each positioning groove 10 is engaged in the slot 220 of the respective buckle block 22, the abutment block 23 is also abutted against the respective concave wall 13 of the electrically conductive plastic member 1, and the proximity grooves 24 of the terminal block 2 are forced into engagement with the respective butting bump 14 of the electrically conductive plastic member 1. In this way, the electrically conductive plastic member 1 and the terminal block 2 are fixed in position. And the other side of the electrically conductive plastic member 1 can be assembled with the other terminal block 2 using the same method described above, so that both sides of the electrically conductive plastic member 1 are assembled with the terminal blocks 2 to complete the assembly of the electrical connector capable of improving high frequency characteristics of the present invention.

The main feature of the present invention is that the electrically conductive plastic member 1 used has better stability than traditional plastic members, which is not easy to be deformed by the preset board. At the same time, the conductive terminals 21 on terminal block 2 can maintain good contact with the metal contacts of the preset board. At the same time, the conductive properties of the electrically conductive plastic member 1 are similar to metal parts. For the power terminals, differential signal pair terminals and ground terminals of the plural conductive terminals 21, the distance between electrically conductive plastic member 1 and the conductive terminals 21 can be used to make good electrical adjustments. In the aforementioned components, the plurality of proximity grooves 24 of the terminal block 2 are provided corresponding to the plurality of ground terminals. Therefore, the distance between the butting bumps 14 of the electrically conductive plastic member 1 and the ground terminals is extremely small, which helps to guide the high-frequency noise of the ground terminal through non-contact conduction into the electrically conductive plastic member 1 for elimination. The plural buckle blocks 22 and the plural abutment blocks 23 are set for the corresponding power terminals or differential signal pair terminals, and the buckle blocks 22 make the power terminals or differential signal pair terminals have a larger spacing, and the abutment blocks 23 produce the second spacing, avoiding the electrically conductive plastic member 1 from generating a metal shielding effect on the power terminals or differential signal pairs, which will affect the transmission of electronic signals. By adjusting the distance between the electrically conductive plastic member 1 and the terminal block 2, the crosstalk and short-circuit problems generated between the conductive terminals 21 can be improved, and the data performance during high-speed signal transmission can be more ideal.

According to the disclosure in FIGS. 1 to 4 above, we can understand that the invention is an electrical connector capable of improving high-frequency characteristics. The electrical connector comprises an electrically conductive plastic member and at least one terminal block. The electrically conductive plastic member comprises a plurality of positioning grooves and a plurality of connecting blocks with a hollow rectangular appearance arranged continuously, a side plate on one side of each positioning groove, a concave wall on the other side of each positioning groove and each of two opposite sides of each connecting block, and a butting bump protruded from at least one side of each of the side plates and the concave walls. The at least one terminal block is assembled in an accommodation space of a preset insulating housing, and is provided with a plurality of conductive terminals composed of a plurality of signal terminals and a plurality of ground terminals. The terminal block comprises a plurality of buckle blocks bent downward from one side thereof and used to be buckled to respective positioning grooves of the electrically conductive plastic member, an abutment block formed on at least one side of each buckle block for abutting against one respective concave wall of the electrically conductive plastic member, and a proximity groove provided between the adjacent buckle blocks or the abutment blocks for one respective butting bump of the electrically conductive plastic member to extend and abut. The electrically conductive plastic member is provided between the two terminal blocks to form a strong structure, and it has both flexibility and ductility when the preset board is inserted. At the same time, it can improve the crosstalk and short circuit problems between the conductive terminals, and the data performance during high-speed signal transmission is more ideal. This invention is used in the field of high-speed transmission electrical connectors, and is an effective structural design to improve high-frequency characteristics, so a patent application was filed to seek patent protection.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An electrical connector capable of improving high frequency characteristics, comprising:

an electrically conductive plastic member comprising a plurality of positioning grooves and a plurality of connecting blocks with a hollow rectangular appearance arranged continuously, a side plate on one side of each said positioning groove, a concave wall on an opposite side of each said positioning groove and each of two opposite sides of each said connecting block, and a butting bump protruded from at least one side of each of said side plates and said concave walls; and at least one terminal block assembled in an accommodation space of a preset insulating housing, each said terminal block being provided with a plurality of conductive terminals composed of a plurality of signal terminals and a plurality of ground terminals, each said terminal block comprising a plurality of buckle blocks bent downward from one side thereof and used to be buckled to respective said positioning grooves of said electrically conductive plastic member, an abutment block formed on at least one side of each said buckle block for abutting against one respective said concave wall of said electrically conductive plastic member, and a proximity groove provided between the adjacent said buckle blocks or said abutment blocks for one respective said butting bump of said electrically conductive plastic member to extend and abut.

2. The electrical connector capable of improving high frequency characteristics as claimed in claim 1, wherein each said buckle block has an inner side thereof recessed with a slot for the snap-fit of one respective said side plate.

3. The electrical connector capable of improving high frequency characteristics as claimed in claim 1, wherein each said buckle block has an arc angle formed on each of two opposite lateral sides of an outer wall thereof; each said positioning groove for one respective said buckle block to be buckled is provided with two arc-shaped walls corresponding to the said arc angles of the respective said buckle block.

4. The electrical connector capable of improving high frequency characteristics as claimed in claim 1, wherein two said terminal blocks are bilaterally assembled with said electrically conductive plastic member, so that a plug-in space is defined between the two said terminal blocks for the insertion of a preset board.

5. The electrical connector capable of improving high frequency characteristics as claimed in claim 1, wherein each said conductive terminal has one end thereof bent outward to form a butting portion, and an opposite end thereof bent to form a bonding portion.

6. The electrical connector capable of improving high frequency characteristics as claimed in claim 1, wherein said proximity grooves of said at least one terminal block are provided corresponding to said ground terminals, and said buckle blocks and said abutment blocks are provided corresponding to said signal terminals.

* * * * *